US008216086B2

(12) United States Patent
Beaulieu

(10) Patent No.: US 8,216,086 B2
(45) Date of Patent: Jul. 10, 2012

(54) CROSSCUT WEDGE GOLF CLUB

(76) Inventor: Steve Beaulieu, Warrenton, VA (US)

( * ) Notice: Subject to any disclaimer, the term of this patent is extended or adjusted under 35 U.S.C. 154(b) by 23 days.

(21) Appl. No.: 12/830,300

(22) Filed: Jul. 3, 2010

(65) Prior Publication Data

US 2010/0279789 A1 Nov. 4, 2010

Related U.S. Application Data

(60) Provisional application No. 61/014,816, filed on Dec. 19, 2007.

(51) Int. Cl.
*A63B 53/04* (2006.01)

(52) U.S. Cl. ..... 473/328; 473/330; 473/331; 473/349

(58) Field of Classification Search ..... 473/330, 473/331, 328, 349; D21/750, 751, 759
See application file for complete search history.

(56) References Cited

U.S. PATENT DOCUMENTS

| | | | | | |
|---|---|---|---|---|---|
| 3,810,631 | A * | 5/1974 | Braly | 473/328 |
| 4,883,275 | A * | 11/1989 | Boone | 473/334 |
| 5,029,864 | A | 7/1991 | Keener | |
| D346,840 | S * | 5/1994 | Fenton | D21/751 |
| 5,354,059 | A | 10/1994 | Stuff | |
| 5,688,186 | A | 11/1997 | Michaels et al. | |
| 5,785,610 | A * | 7/1998 | Birmingham | 473/331 |
| 5,964,669 | A * | 10/1999 | Bloomer | 473/250 |
| 6,048,277 | A * | 4/2000 | Raymond | 473/331 |
| 6,309,310 | B1 | 10/2001 | Shira | |
| 6,348,010 | B1 | 2/2002 | Doolen | |
| 6,464,598 | B1 * | 10/2002 | Miller | 473/314 |
| 6,471,601 | B1 * | 10/2002 | McCabe et al. | 473/290 |
| 6,569,029 | B1 * | 5/2003 | Hamburger | 473/238 |
| 6,605,006 | B2 * | 8/2003 | Mason | 473/252 |
| 6,981,923 | B2 | 1/2006 | Chappell | |
| 7,066,833 | B2 | 6/2006 | Yamamoto | |
| 7,156,751 | B2 | 1/2007 | Wahl et al. | |
| 7,258,627 | B2 | 8/2007 | Chappell | |
| 7,758,449 | B2 * | 7/2010 | Gilbert et al. | 473/330 |
| 7,846,033 | B2 * | 12/2010 | Kato et al. | 473/242 |
| D634,804 | S * | 3/2011 | Beaulieu | D21/759 |
| 7,918,747 | B2 * | 4/2011 | Johnson et al. | 473/328 |
| 2002/0183132 | A1 * | 12/2002 | Said et al. | 473/314 |
| 2005/0043113 | A1 | 2/2005 | Mann, Jr. et al. | |
| 2007/0191130 | A1 * | 8/2007 | Kouldus | 473/251 |
| 2009/0221384 | A1 * | 9/2009 | Kato et al. | 473/331 |

* cited by examiner

*Primary Examiner* — Sebastiano Passaniti
(74) *Attorney, Agent, or Firm* — Shawna J. Shaw

(57) ABSTRACT

A wedge-type golf club having a plurality of parallel grooves offset at an angle with respect to the base of the club face. The grooves provide enhanced backspin and control on a golf ball when struck with the club face open. The grooves are beneficial for "getting the ball up" and stopping the ball on the green using an open face approach.

12 Claims, 7 Drawing Sheets

"Prior Art"

"Prior Art"

CROSSCUT WEDGE GOLF CLUB

This application claims benefit to U.S. Provisional Application No. 61/014,816 filed Dec. 19, 2007 and U.S. Non-Provisional application Ser. No. 12/273,520 filed Nov. 18, 2008, the entire contents incorporated herein by reference.

BACKGROUND OF THE DISCLOSURE

1. Field of the Disclosure

The present disclosure relates generally to golf clubs. More specifically, the present disclosure relates to a golf club head for hitting a golf ball from an open face position.

2. Background of the Disclosure

Golf clubs are used for striking a ball in the game of golf and are generally comprised of a shaft coupled to a clubhead via a hosel. In addition, the shaft usually includes a grip for holding the golf club. Generally speaking, there are three types of clubs: woods, irons and putters. Woods are used for long distance fairway shots, irons are used for shots approaching the green, and putters are used on the green to hit the ball into the cup. The present diclosure is directed to irons, and particularly wedges. Wedges are irons typically having a loft higher than 52° and are used for short-distance, high-altitude shots such as hitting the ball onto the green or getting the ball out of the rough. Examples of such wedges include gap, sand, and lob wedges. Loft is measured by the angle between the club's face and the vertical plane. Clubs with shorter shafts and higher lofts typically give the ball a higher and shorter trajectory. Table 1 below shows typical loft angles for different wedge types.

TABLE 1

| Wedge Type | Traditional Loft |
|---|---|
| gap | 48-54° |
| sand | 54-58° |
| lob | 58-64° |

Clubheads may take on a variety of forms, but typically comprise a face, toe, heel, crown, and sole. The United States Golf Association (USGA) provides rules and specifications for approved club designs. Such rules may be found in Appendices II and III of the "Rules of Golf" and are incorporated herein by reference in their entirety. "The Rules of Golf" is a standard reference that represents the ordinary and custom usage of golf terms. Appendix II, in particular, sets forth standard specifications and terms for golf club design as agreed upon by the golf community. Here, the "toe," "heel," "sole," "crown," and "back" are used as reference points to set forth clear specifications for approved club head dimensions.

In general, the "toe" refers to the portion of the club face farthest from the hosel or shaft, the "heel" refers to the portion of the club face closest to the hosel or shaft, and the "sole" refers to the bottom portion of the club head that typically contacts the ground. The "leading edge" of the club head is the front-most edge where the club face and the sole intersect, and "trailing edge" is the rear-most edge where the sole meets the back of the club head. "Bounce angle" refers to the angle formed between the leading edge of the club head at address and the ground. Wedges typically have bounce angles somewhere between 5-12.° One purpose of higher bounce angles is to more easily penetrate the ground under the ball in the rough or sandy areas.

During a stroke, the club head serves to compress the ball and grooves on the club face help to impart spin on the ball.

"Backspin" is a type of spin that moves in a fast clockwise motion as viewed from a parallel standpoint to the left of the ball. It is the combination of compression and backspin that help to give the ball aerodynamic lift. Typically, more backspin equals more control.

Grooves on the face of the club serve several purposes. As mentioned, grooves promote spin on the golf ball to help control flight. Additionally, grass can often interfere between the ball and the club face. Since grass is mostly water, the water must have someplace to go. Thus, the grooves also function in a manner similar to treads on a tire—to get the water out—and thus help to maintain contact with the ball.

Regarding grooves, current USGA specifications state that: the width and cross-section of grooves must be consistent across the face of the club and along the length of the grooves; any rounding of groove edges shall be in the form of a radius which does not exceed 0.20 inches; the width must not exceed 0.035 inches; the distance between edges of adjacent grooves must not be less than three times the width of a groove, and not less than 0.075 inches; and the depth of a groove must not exceed 0.020 inches.

Normally, it is desirable to have the club face "square" to the ball (90° with respect to the target line) at impact. In some cases, however (e.g., when performing short chip shots to the green), players may "open" the club face in order to hit the ball higher. This is done by rotating the face outward such that the toe is behind the heel at impact.

Opening the club face changes several factors. One negative factor is that the grooves are no longer square to the ball or the target line. Consequently, inadequate backspin and undesirable sidespin result. Another drawback is the increased likelihood for higher handicappers to strike the ball in the smooth toe with the club face open. This reduces backspin and control even further. Opening the club face also enables the loft to be effectively increased, however at the same time may cause the bounce angle to become too high. High bounce angles are the primary cause of "thinned" shots—where the ball is struck along the leading edge. A further drawback to opening the club face is that glare may be increased—reducing player visibility and striking accuracy. Still yet another drawback to opening the club face is that "feel" and control of the club may be reduced.

There is therefore a need for a golf club head that imparts improved backspin on a ball when struck with the club face open. A need also exists for a golf club head that provides more control and stopping power when hitting a ball with the club face open.

There is also a need for a trailing edge that accommodates the open position and allows the loft to be effectively increased while avoiding thinned shots traditionally associated with high bounce angles. There is further a need for a club head having a material for reducing glare in an open position. Moreover, there is a need for a longer hosel that provides improved feel and control in the open face position. The present disclosure addresses these needs and others.

SUMMARY OF THE DISCLOSURE

The present disclosure overcomes drawbacks of the prior art by providing "crosscut" grooves offset at an angle across the face of a club head. Such grooves are optimally aligned to be square with the ball and/or target line in the open position and to impart effective backspin on a ball for stopping it on the green when struck with the club face open. In embodiments, the grooves are offset between 22-30° with respect to the base of the club face, and preferably between 25-30°. By improving backspin from an open face approach, golfers are able to get the ball up easier and are afforded more control and stopping power. The present disclosure additionally overcomes certain drawbacks of the prior art by providing grooves on the club face that extend into the toe, thereby increasing the usable impact area in the open position. Preferably, the disclosed grooves conform to USGA rules and standards. The present disclosure further overcomes certain drawbacks of the prior art by providing a trailing edge parallel with the ground in an open position that allows the loft angle to be increased while avoiding thinned shots associated with increased bounce angles. In addition the present disclosure overcomes other drawbacks of the prior art by providing a low glare material, and a long hosel for improved feel and control.

According to one aspect, the disclosure provides a wedge golf club for striking a golf ball. The club comprising: a shaft; and a club head coupled to the shaft by a hosel, the club head including: a) a club face; the club face having a toe, a heel, and a plurality of parallel, non-intersecting grooves extending into the toe, the grooves aligned at an angle offset in the direction of the shaft, the offset angle between 25-30° with respect to the base of the club face, the grooves substantially consistent across the club face; b) a crown defining an upper region of the club head; and c) a sole defining a lower region of the club head, the sole having a leading edge intersecting the club face, and a trailing edge intersecting a back portion of the club head opposite the club face, the trailing edge of the sole substantially parallel with the ground in an open face position.

According to another aspect, the disclosure provides a wedge golf club for striking a golf ball. The club comprising: a shaft; and a club head coupled to the shaft by a hosel, the club head including: a) a club face; the club face having a toe, a heel, and a plurality of parallel, non-intersecting grooves extending into the toe, the grooves aligned at an angle offset in the direction of the shaft, the offset angle between 25-30° with respect to the base of the club face, the grooves substantially consistent across the club face; b) a crown defining an upper region of the club head; and c) a sole defining a lower region of the club head, the sole having a leading edge intersecting the club face, and a trailing edge intersecting a back portion of the club head opposite the club face, where the trailing edge is flat and rests on the ground when the club head is in an open-face position.

According to yet another aspect, the disclosure provides a golf club head having a hosel for coupling to a shaft. The club head comprising: a) a club face; the club face having a toe, a heel, a leading edge, and a plurality of parallel, non-intersecting grooves extending across the club face and into the toe, the grooves aligned at an angle offset between 25-30° with respect to the base of the club face in the direction of the shaft; b) a crown defining an upper region of the club head; and c) a sole defining a lower region of the club head, the sole having a leading edge intersecting the club face and a trailing edge intersecting a back portion of the club head opposite the club face, where the trailing edge is flat and rests on the ground when the club head is in an open-face position.

One of several advantages of the disclosed club head is its ability to impart effective backspin and a substantially straight trajectory on a ball when struck with the club face open. As a result, golfers are able to get the ball up and stop it quickly on the green. Furthermore, by offsetting the grooves to be more optimally aligned with the ball and target line in the open face position, control may be significantly improved.

As a result of improving the amount of backspin using an open face approach, better precision shots onto the green may be achieved. The disclosed golf club helps golfers to get under the ball in order to "get the ball up" (from deep lies, hard pan, sand, etc.). Therefore, of the many other advantages provided by the device, it improves performance e.g., for higher handicappers who tend to hit the ball in the toe portion when opening the club face.

The golf club of the present disclosure is thus configured to improve control and stopping power from an open-face approach. Specifically, it has been observed that grooves in the toe region having an offset angle between 22-30°, and preferably 25-30°, in the direction of the shaft provide significantly improved stopping power. This is partly because opening the club face increases the likelihood of striking the ball in the toe region. Also, an open approach translates to a 22-30° groove offset angle to optimally keep the grooves "square" with the ball and the target line. In addition, by grinding the trailing edge of the sole to be substantially flush with the ground in an open face position, the effective loft may be increased while avoiding "thinning" associated with higher bounce angles. Thus, it is a synergistic effect of "getting under the ball" with an open club face (resulting in a higher trajectory), and increasing backspin with the offset grooves that results in significantly enhanced stopping power.

Preferably, the groove configurations and dimensions conform to USGA specifications and standards. It is appreciated that grooves having any approved configuration may be used including square, V-shaped, U-shaped, etc. It is further appreciated that any USGA-approved dimensions (width, depth, length, spacing, etc.) may be used.

The disclosed club may be manufactured using a variety of techniques. For example, the club head may be forged, cast, die-stamped, machined, hand-cut, or the like. Materials for the shaft and/or club head may include, but are not limited to, soft carbon steel, stainless steel, and titanium. In embodiments, the club head and/or shaft is composed of 1018 soft carbon steel that provides the golfer with more "feel" because it is softer than stainless steel.

The club face may further have a glare reducing surface such as dark-black oxide, gunmetal finish, or the like to reduce glare when the club face is open. Because a larger flatter surface is created when the club face is open, glare often becomes an interfering factor. By specifically using a low-glare material on the club head or club face, a golfer's view of the open club face is improved.

In embodiments, an extra long hosel provides improved feel and control.

It is further appreciated that the club may be designed to have varying degrees of bounce. In embodiments, the sole of the club head may be ground to readily accommodate an open face position while avoiding "thinning"

DETAILED DESCRIPTION OF VARIOUS EMBODIMENTS OF THE DISCLOSURE

Figure 1A:
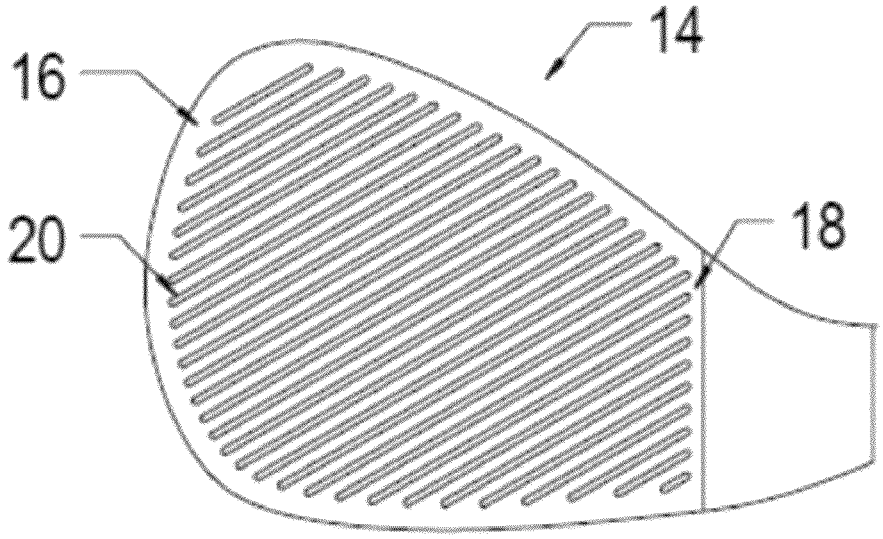
FIG. 1*a* shows a top view of a club face according to one embodiment of the present disclosure.

Reference will now be made in detail to various exemplary embodiments of the disclosure, examples of which are illustrated in the accompanying drawings. It is understood that that drawings are not necessarily to scale, but are representative of the features of the present disclosure. The following detailed description describes certain embodiments of the disclosure, and should not be considered as limiting the disclosure to those embodiments.

Precision shots onto the green require a higher spin rate and loft. Higher spin and loft help the ball to check up quickly on the green or release to the hole. Sometimes, a chip shot onto an away-ward sloping green requires the player to adjust the trajectory to a higher loft to keep the ball from rolling off the green. Higher spin rates and loft may be achieved by choosing a club with a higher number (corresponding to degree of loft)—or by opening the club face.

Opening the club face creates additional loft, but renders the horizontal grooves on conventional clubs much less effective for stopping the ball on the green. This is because the grooves are no longer square to the target line when the face is open. In other words, the grooves are not optimally aligned for imparting effective backspin on the ball, resulting in undesirable sidespin and/or insufficient backspin. It can thus be seen that higher spin rates and better control are difficult to achieve when opening the club face of conventional clubs. Figuratively, this can be translated that conventional clubs have no "brakes" for stopping a ball on the green with an open face approach.

The present disclosure addresses the problems associated with attempting precision shots on the green with an open club face. To remedy these problems, the present disclosure provides a plurality of grooves offset at an angle substantially across the club face. The grooves are offset at an angle sufficient to impart effective backspin on the ball for getting it up and stopping it on the green. According to embodiments, the grooves on the club face are aligned between 22-30°, and preferably 25-30°, with respect to the base of the club face. According to further embodiments, the offset grooves continue substantially to the outside edges of the club face to increase the amount of usable impact area in the open position.

The present disclosure thus improves spin imparted to a ball when struck with an open club face while enabling a substantially straight trajectory (where hooks and slices are reduced). As a result, better precision shots having a higher spin rate and loft may be achieved. The disclosed golf club also helps higher handicappers, for example, to "get the ball up" (from deep lies, hard pan, sand, etc.) and provides improved stopping power for landing the ball on the green.

Preferably, the disclosed grooves are designed to conform to USGA standards and specifications. Accordingly, grooves having any USGA-approved configuration or dimensions (e.g., length, width, depth, spacing, etc.) may be used. In addition, the grooves may be square, V-shaped, U-shaped, etc.

Turning now to the figures, which depict various exemplary embodiments of the disclosure, FIG. 1*a* shows a top view of a club face 14 according to one embodiment of the present disclosure. The club face 14 includes a toe 16 and a heel 18. In this embodiment, a plurality of grooves 20, are aligned at about a 30° offset with respect to the base of the club face 14. In other embodiments, the grooves are aligned at an offset angle between 22-30°. As a result, the offset grooves 20 are more optimally aligned with the ball when the club face is opened to achieve a substantially straight trajectory and improved backspin. Consequently, the offset grooves 20 provide enhanced spin, control and stopping power on a ball when hit with the club face 14 open.

Preferably, the golf club is a wedge having a 52-64° loft angle. However it is appreciated that enhanced spin, control and stopping power may be achieved by opening the face of any wedge with any associated loft angle. In some cases, opening the club face 14 may serve to further increase the loft of the club to be greater than 64°. Such loft angles may be desirable for improving precision shots and helping higher handicappers, for example, to "get the ball up."

Figure 1B:
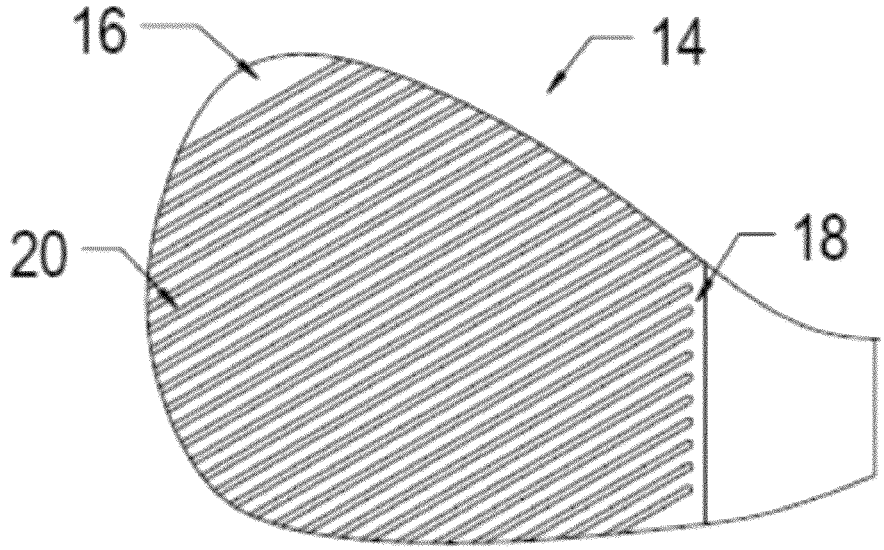
FIG. 1*b* shows a top view of a club face according to another embodiment of the present disclosure.

FIG. 1*b* shows a top view of a club face 14 having a toe 16, heel 18, and a plurality of grooves 20 also aligned at about a 30° offset. In this figure, the grooves 20 extend substantially to the edge, or outer portion, of the club face 14. By extending the grooves substantially to the edge of the club face, more water may be eliminated from the face surface and/or the amount of usable impact area increased.

Figure 2A:
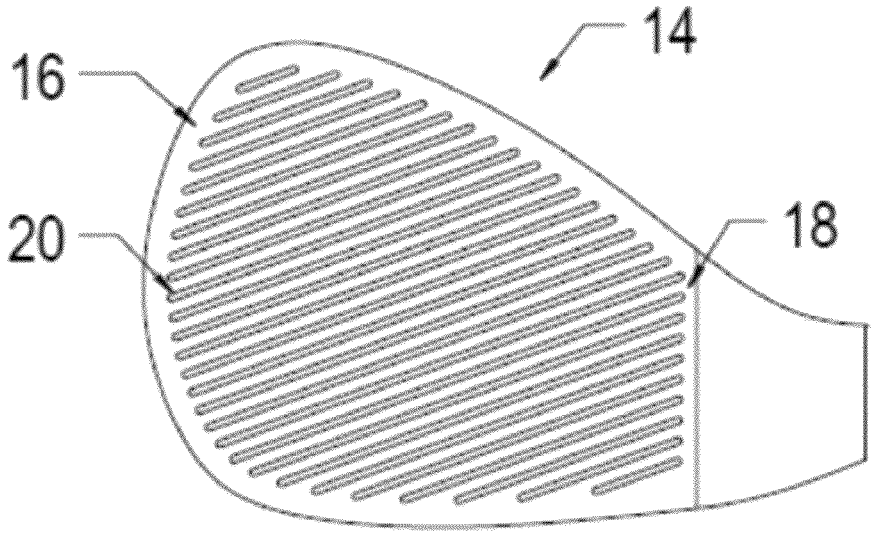
FIG. 2*a* shows top view of a club face according to another embodiment of the present disclosure.

FIG. 2*a* shows a top view of a club face 14 according to another embodiment of the present disclosure. Again, the club face 14 includes a toe 16 and a heel 18. In this embodiment, grooves 20 are aligned at about a 22° offset with respect to the base of the club face 14. As a result, the offset grooves 20 are more optimally aligned with the ball when the club face is opened to achieve a substantially straight trajectory and improved backspin. Consequently, the offset grooves 20 provide enhanced spin, control and stopping power on a ball when hit with the club face 14 open.

Figure 2B:
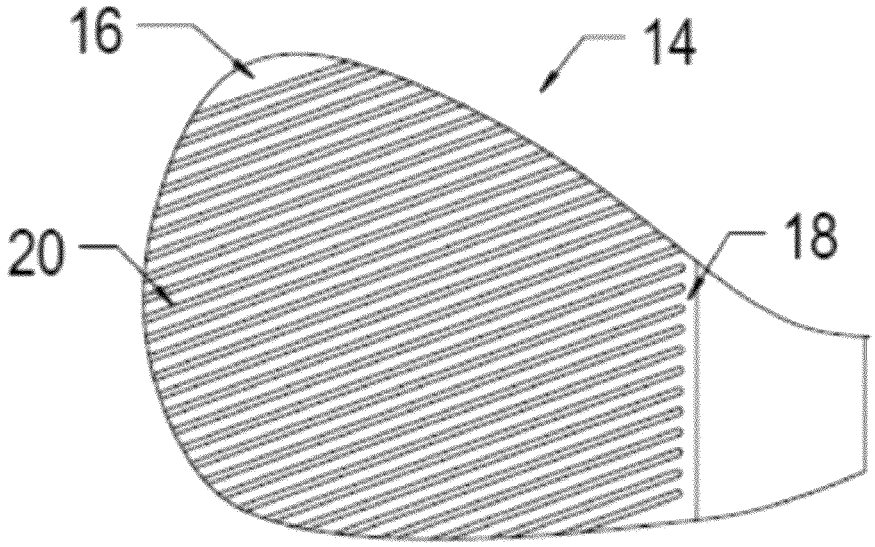
FIG. 2*b* shows top view of a club face according to another embodiment of the present disclosure.

FIG. 2*b* shows a top view of a club face 14 having a toe 16, heel 18, and a plurality of grooves 20 aligned at about a 22° offset. In this figure, the grooves extend substantially to the edge, or outer portion, of the club face 14. Such a feature remedies problems encountered with conventional clubs where the impact area is greatly reduced in the open position. Such a feature also allows more water to be eliminated from the face surface, thereby further improving contact with the ball.

Figure 3:
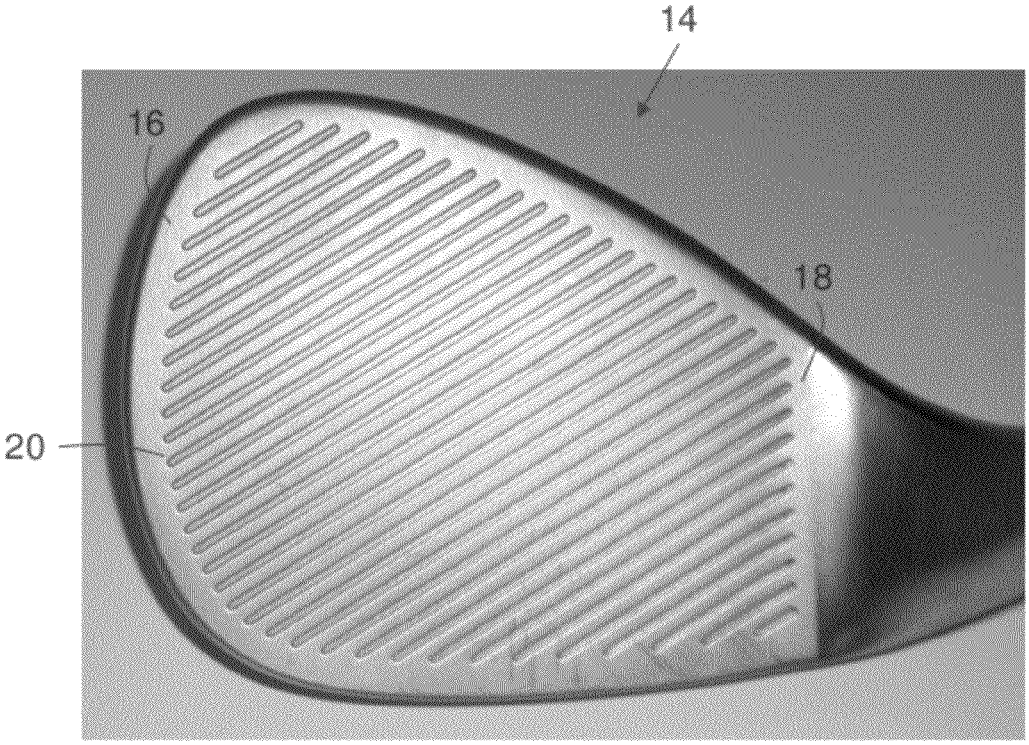
FIG. 3 shows a top view of a club face according to another embodiment of the present disclosure.

FIG. 3 shows a photograph of a golf club face 14 manufactured according to inventive concepts of the present disclosure. Again, the club face 14 includes a toe 16 and heel 18. As shown, the grooves 20 are offset at an angle and extend substantially across the club face 14 including the toe 16. As depicted in the figure, the outer edges of the club face 14 are smoothed e.g., for aesthetic, safety, or other reasons. For example, if the club head is manufactured from forged soft carbon steel, the edges may be ground to obtain a smoother edge. In embodiments, the grooves 20 may be die-stamped or milled (either by hand or machine) into the club face 14, or an equivalent technique used.

Figure 4:
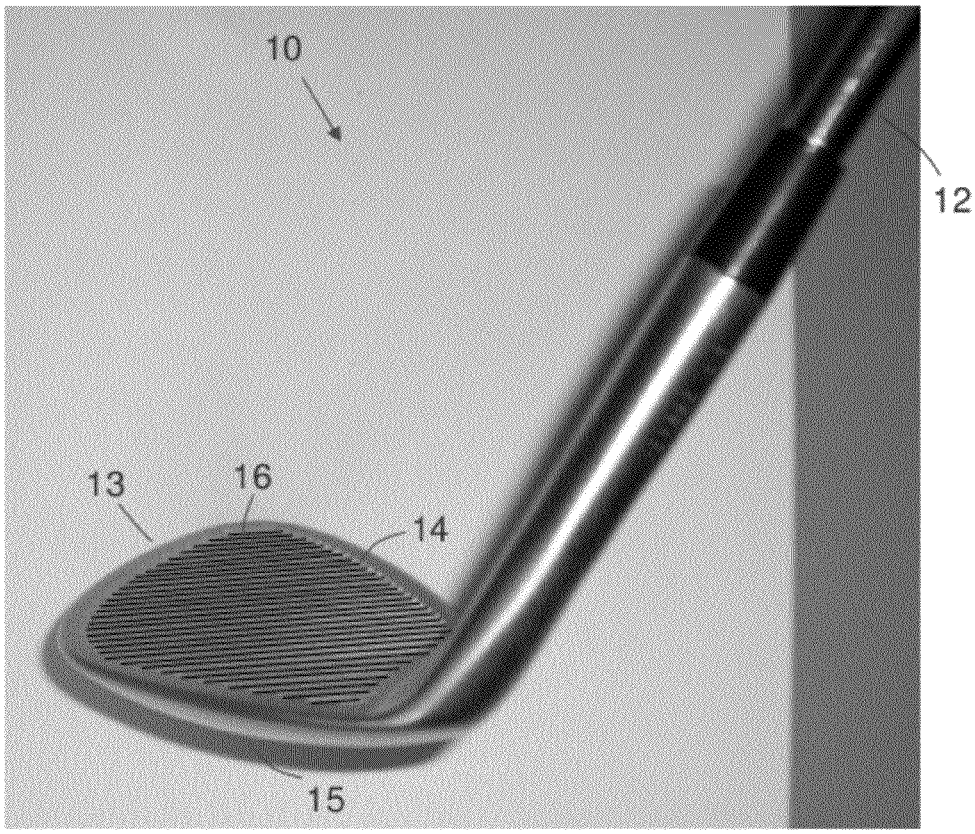
FIG. 4 shows an isometric view of a golf club according to a preferred embodiment of the present disclosure.

FIG. 4 shows an isometric view of a golf club 10 according to an embodiment of the present disclosure. As shown, the golf club 10 includes a club head 13 coupled to a shaft 12. The club head 13 includes a sole 15 and a face 14 having a groove configuration as discussed with respect to FIGS. 1-3. Preferably, the golf club 10 is a wedge-type club with a loft angle between 52-64°. It is appreciated that the shaft 12 may comprise any conventional shaft, and in embodiments may include a True-Temper™ parallel shaft. In addition, it is understood that the shaft 12 may also include a grip (not shown) as will be appreciated by those skilled in the art.

Figure 5A:
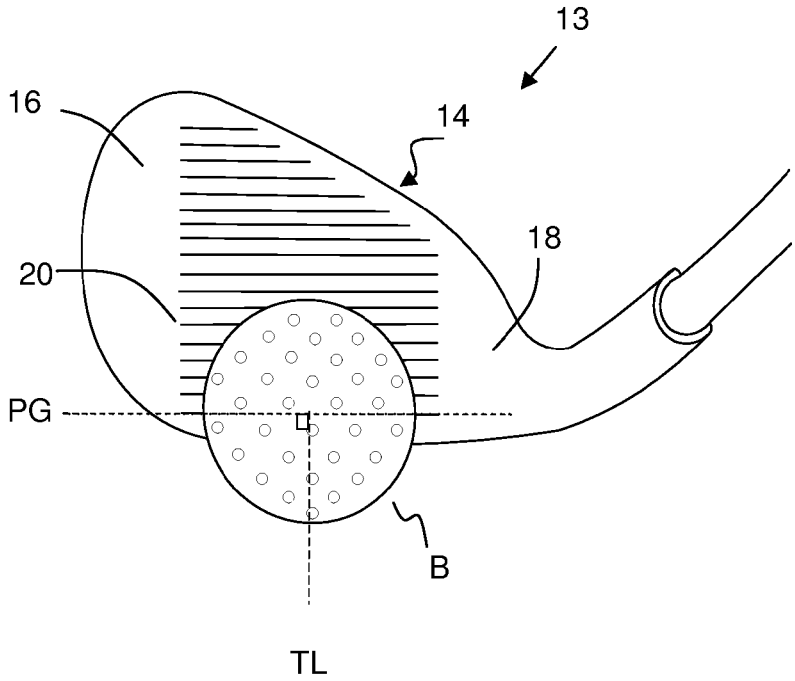
FIG. 5*a* depicts a prior art wedge with a front address.

FIG. 5*a* depicts a front view of a prior art club head 13 with a normal address. The club face 14 includes a toe 16, heel 18, and a plurality of grooves 20. As can be seen in FIG. 5*a*, the horizontal grooves 20 are parallel to the ground (as indicated by line PG) and are "square" to the ball B and intended target line TL.

Figure 5B:
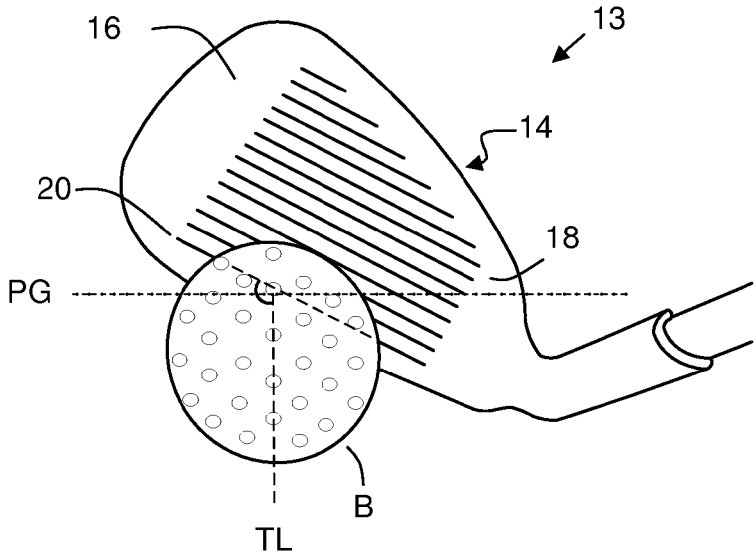
FIG. 5*b* depicts a prior art wedge with an open address.

FIG. 5*b* depicts a prior art club approaching a ball B from an "open" address. Here, the horizontal grooves are no longer parallel to the ground (as indicated by line PG), and are no longer square to the ball B or intended target line TL. Moreover, it can be seen how the ball may be more readily struck by the smooth toe—adversely affecting one's stroke.

Figure 5C:
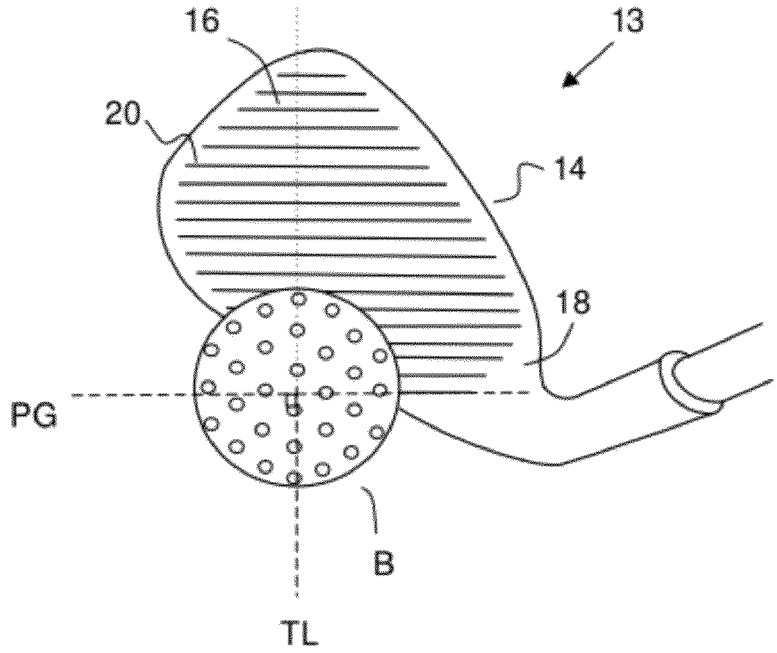
FIG. 5*c* depicts a front view of a club according to the principles of the present disclosure with an open address.

FIG. 5*c* depicts a club head 13 approaching a ball from an open address according to principles of the present disclosure. Again, the club face 14 includes a toe 16, heel 18, and a plurality of grooves 20. The grooves are offset about 25° in the direction of the shaft. It can be seen here that the grooves 20 are optimally normal with the ball B and the target line TL with an open address. In addition, the grooves extend into the toe 16 to increase backspin on the ball B when struck in this region from an open approach.

Figure 5D:
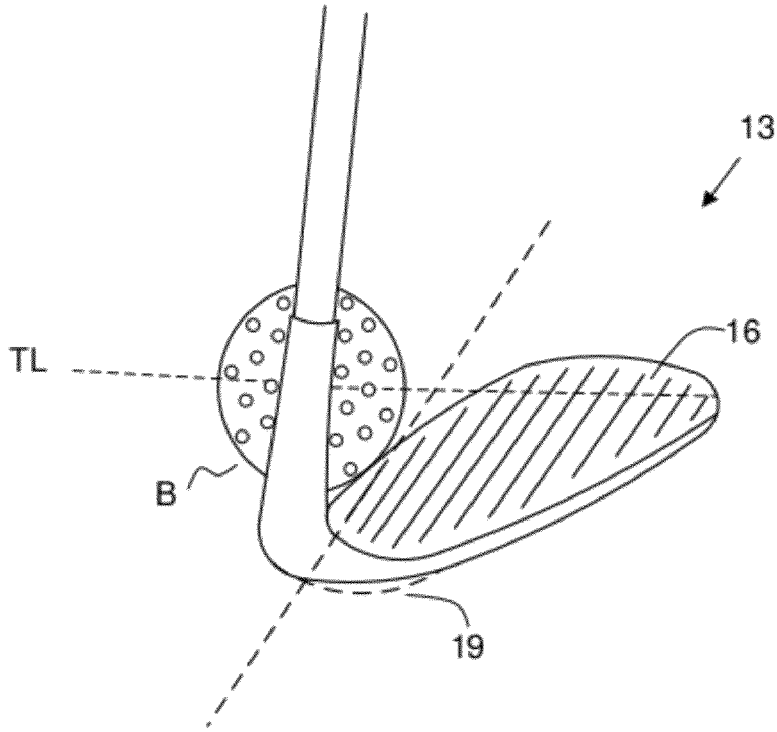
FIG. 5*d* depicts an isometric view of a club according to the principles of the present disclosure with an open address.

FIG. 5*d* depicts an isometric view of a club head 13 approaching a ball B from an open position according to the principles of the present disclosure. This figure shows where the trailing edge 19 is ground to lie flat or parallel with the ground in an open position. Because opening the club face 14 effectively increases the bounce angle, the trailing edge 19 is ground such that the leading edge is not raised too high so as to interfere with a shot.

Figure 6:
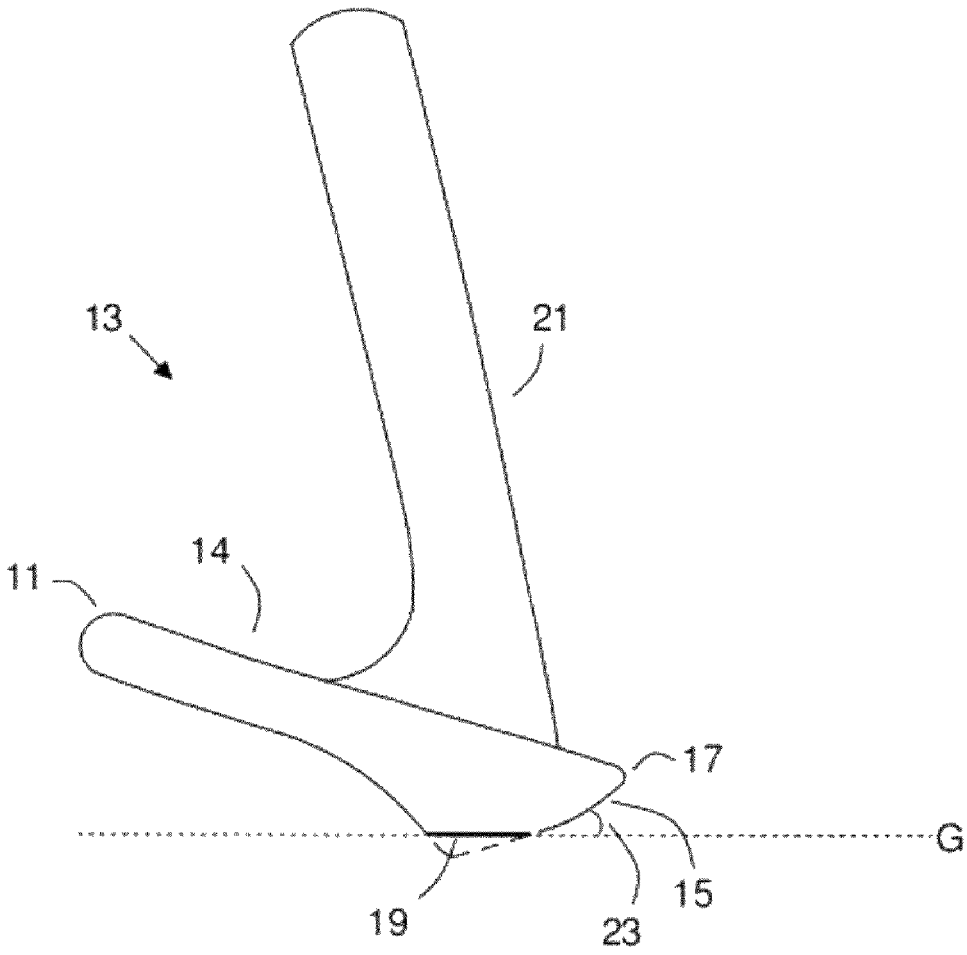
FIG. 6 depicts a side view of a club according to the principle of the present invention.

FIG. 6 depicts a side view of a club head 13 according to principles of the present disclosure. Again, the club head 13 comprises a club face 14, crown 11, sole 15, leading edge 17, trailing edge 19, and hosel 21. It can be seen here that the trailing edge 19 of sole 15 is ground down so that the trailing edge 19 is parallel with the ground from an open face address. Since opening the club face 14 increases the effective bounce angle of traditional clubs (increasing the probability of a leading-edge strike), the ground, or flat, trailing edge 19 keeps the leading edge 17 from being raised too high.

The golf club 10 of the present disclosure may be manufactured using a variety of conventional processes and/or techniques. In embodiments, the club head 13 may be forged, cast, die-stamped, machined, hand-cut, or the like. It is also appreciated that the club head 13 may be comprised of soft carbon steel, stainless steel, titanium, etc. In preferred embodiments, the club head 13 is composed of 1018 soft carbon steel that provides the golfer with more "feel" because it is softer than stainless steel.

The club head 13 may further have a dark-black oxide, gunmetal finish, or the like to reduce glare when the club face is open. Because a larger flatter surface is created when the club face is open, glare often becomes an interfering factor. By specifically providing a low-glare finish on the club head, a golfer's view of the open club face is improved.

As mentioned, the edges of the club face 14 may be ground or smoothed e.g., for aesthetic, safety and/or other purposes. In addition, by grinding down the trailing edge 19 of the sole 15, the toe of the club head 13 may be more controllably tilted back to an open face position. According to various embodiments, it is appreciated that the trailing edge of the sole may be ground to accommodate an open position where the toe is rotated back anywhere from 5-20°.

In further embodiments, an extra long hosel 21 provides a higher center of gravity and thus better feel and control in the open face position (see FIG. 6).

It is appreciated that the shaft 12 may comprise any conventional shaft, and in embodiments may include a True-Temper™ parallel shaft. In addition, it is understood that the shaft 12 may also include a grip (not shown) as will be appreciated by those skilled in the art.

It can thus be seen that the present disclosure provides solutions for performing precision shots on the green with the club face open. The present disclosure provides a plurality of grooves offset at an angle for imparting spin on the ball with an open face approach. Consequently more spin and control is imparted on the ball thereby increasing its stopping ability on the green. The disclosed club further helps to stop the ball on the green and improves user performance with an open face approach.

The foregoing disclosure of the preferred embodiments of the present disclosure has been presented for purposes of illustration and description. It is not intended to be exhaustive or to limit the disclosure to the precise forms disclosed. For example, it is contemplated that the grooves may be provided on an insert or face so as to be removable or interchangeable. Many variations and modifications of the embodiments described herein will be apparent to one of ordinary skill in the art in light of the above disclosure.

The invention claimed is:

1. A wedge golf club for striking a golf ball, the club comprising:

a shaft; and a club head coupled to the shaft by a hosel, the club head including:

a) a club face; the club face having a toe, a heel, and a plurality of parallel, non-intersecting grooves extending into the toe, the grooves aligned at an angle offset in the direction of the shaft, the offset angle between 25-30° with respect to the base of the club face, the grooves substantially consistent across the club face;

b) a crown defining an upper region of the club head; and c) a sole defining a lower region of the club head, the sole having a leading edge intersecting the club face and a trailing edge intersecting a back portion of the club head opposite the club face, the trailing edge of the sole substantially parallel with the ground in an open-face position, whereby the grooves are oriented substantially normal to a target line in an open-face position.

2. The golf club of claim 1, where the grooves extend substantially across the entire club face.

3. The golf club of claim 1, where the club head is comprised of forged 1018 soft carbon steel.

4. The golf club of claim 1, where the club face has a glare-reducing surface.

5. A wedge golf club for striking a golf ball, the club comprising:

a shaft; and a club head coupled to the shaft by a hosel, the club head including:

a) a club face; the club face having a toe, a heel, and a plurality of parallel, non-intersecting grooves extending into the toe, the offset angle between 25-30° with respect to the base of the club face in the direction of the shaft, the grooves substantially consistent across the club face;

b) a crown defining an upper region of the club head; and c) a sole defining a lower region of the club head, the sole having a leading edge intersecting the club face and a trailing edge that intersects a back portion of the club head opposite the club face, where the trailing edge is flat and rests on the ground when the club head is in an open-face position, whereby the grooves are oriented substantially normal to a target line in an open-face position.

6. The golf club of claim 5, where the grooves extend substantially across the entire club face.

7. The golf club of claim 5, where the club head is comprised of forged 1018 soft carbon steel.

8. The golf club of claim 5, where the club face has a glare-reducing surface.

9. A golf club head having a hosel for coupling the head to a shaft, the club head comprising:

a) a club face; the club face having a toe, a heel, a leading edge, and a plurality of parallel, non-intersecting grooves extending across the club face and into the toe, the grooves aligned at an angle offset between 25-30° with respect to the base of the club face in the direction of the shaft;

b) a crown defining an upper region of the club head; and c) a sole defining a lower region of the club head, the sole having a leading edge intersecting the club face and a trailing edge intersecting a back portion of the club head opposite the club face, where the trailing edge is flat and rests on the ground when the club head is in an open-face position, whereby the grooves are oriented substantially normal to a target line in an open-face position.

10. The club head of claim 9, where the grooves extend substantially across the entire club face.

11. The club head of claim 9, where the club head is comprised of forged soft carbon steel.

12. The club head of claim 9, where the club face has a glare-reducing surface.

* * * * *